United States Patent [19]

Bergen

[11] 4,052,092

[45] Oct. 4, 1977

[54] LATCH OPERATING DEVICE INCLUDING OPERATING AND LATCH CONNECTION IMPROVEMENTS

[75] Inventor: Gary Richard Bergen, Yorba Linda, Calif.

[73] Assignee: Emhart Industries, Inc., Farmington, Conn.

[21] Appl. No.: 743,284

[22] Filed: Nov. 19, 1976

[51] Int. Cl.[2] ..... E05C 1/14

[52] U.S. Cl. ..... 292/172; 70/462; 292/142; 292/244; 292/358

[58] Field of Search ..... 292/39, 51, 112, 142, 292/160, 172, 199, 244, 245, 336.5, 358, 359, DIG. 60, DIG. 64; 70/462

[56] References Cited

U.S. PATENT DOCUMENTS

| | | | |
|---|---|---|---|
| 1,968,285 | 7/1934 | Egan | 292/172 |
| 2,702,204 | 2/1955 | Collier | 292/358 |
| 3,704,036 | 11/1972 | Gerlach | 292/167 |

FOREIGN PATENT DOCUMENTS

| | | | |
|---|---|---|---|
| 1,300,293 | 6/1962 | France | 292/199 |

*Primary Examiner*—Roy D. Frazier

*Assistant Examiner*—Thomas J. Holko

*Attorney, Agent, or Firm*—Mahoney, Schick & Cislo

[57] ABSTRACT

The latch operating spindle is of the type requiring the exact same specific positioning orientation with the latch regardless of the latch side at which the latch operating device is mounted and the spindle is connected to its latch operating device normally operable partially rotatable by the operating device in a normal engaged position, but selectively movable along its rotational axis against compression spring urging to a freely rotatable position in which the spindle may be reversely repositioned adapting it for the alternate positioning use. The mechanism of the latch operating device is preferably thumb lever actuated and includes a slideable rack selectively directly moved by the thumb lever operably engaged with a rotatable pinion. The pinion is secured with the latch operating spindle such that in the spindle normal engaged position, the pinion is operably engaged with the rack and when the spindle is moved to its temporary freely rotatable position, the pinion is moved therewith out of engagement with the rack so as to automatically permit the spindle repositioning relative to the latch it is intended to operate.

14 Claims, 8 Drawing Figures

LATCH OPERATING DEVICE INCLUDING OPERATING AND LATCH CONNECTION IMPROVEMENTS

BACKGROUND OF THE INVENTION

This invention relates to a latch operating device of the type making use of a spindle of the form requiring particular exact side positioning orientation relative to the latch being operated and regardless of the latch side at which such operating mechanism is positioned. According to certain of the principles of the present invention, a unique form of connection is provided between the spindle and its latch operating mechanism within which it is integrated such that the spindle is selectively positionable with the latch operating mechanism in either of two opposite required and positive operational positions, thereby very simply selectively adapting the assembly to overall positioning for properly operating the particular latch from either side of the door within which it is mounted without the use of substitute parts. Furthermore, due to the inherent broad structure of the unique form of spindle connection, the overall latch operating mechanism may be greatly simplified into a positively operable form requiring less complexity and reducing fabrication costs, while still maintaining an increased efficiency of operation.

A certain prominent group of prior door latch constructions require that the spindle partially rotating to operate the same be in a particular same positioning orientation relative to the latch being operated regardless of the side of the door from which the spindle principally extends and at which the latch operating mechanism with which the spindle is operationally connected is mounted. The particular spindle shapes are generally half-round spindles and such spindles with the particular form of latch that they operate much always be positioned with the generally semi-circular outer surfaces thereof extending in a particular latch longitudinal direction. This meant that if the latch operating mechanism was mounted at one side of the door with the spindle extending therefrom into operational engagement with the latch or if the latch operating mechanism with its spindle was mounted at the opposite side of the door, the spindle was required to be positioned facing in the exact same longitudinal direction regardless of the particular door side mounting. The overall result was that two different latch operating device models were required, despite the fact that the only differences therebetween were the particular positioning of the spindles relative to their latch operating mechanisms.

In more recent times, in order to eliminate the foregoing problem, certain modifications were made in the manner of mounting the spindles with their latch operating mechanisms so as to permit selective complete disassembly of the spindles from their latch operating mechanisms, reverse positioning of the spindles and then the reassembly with their latch operating mechanisms. In this manner, it was possible to supply merely a single model of the latch operating devices and they could be altered through properly instructed procedure at the site of installation for adapting the same to the particular door side positioning. Such modified construction is shown in the prior U.S. Pat. No. 3,704,036, issued Nov. 28, 1972 and entitled "THUMB LEVER ACTUATED LATCH OPERATING DEVICE."

Referring to the prior U.S. Pat. No. 3,704,036, and regardless of whether or not the particular latch operating mechanism associated with the half-round spindle is thumb lever actuated or otherwise, the half-round spindle is connected to the latch operating mechanism through a hollow, cylindrical retainer having spring actuated, alternate, semi-circular sockets formed therein. Thus, if the particular latch operating mechanism is to be mounted at one side of the door, the half-round spindle is inserted into the proper socket of the spindle retainer so that proper positioning orientation is obtained with the latch within the door, and if the latch operating mechanism is to be mounted at the other side of the door, the half-round spindle is merely selectively disengaged from the one spindle retainer socket and inserted in the other or opposite socket for such proper latch positioning orientation. With either spindle retaininer positioning, the latch operating mechanism is operable to partially rotate the spindle retainer and its socket retained spindle for the usual actuation of the engaged latch.

Although the alternate spindle retainment arrangement as described effectively solves the problem of the requirement that alternate latch operating devices be provided for the alternate door side positioning and provided a single model replacing the two, certain difficulties have been experienced therewith. Obviously, since the spindle is retained in the spindle retainer sockets are merely a relatively short end portion thereof and must extend from the latch operating mechanism for a moderate distance to pass through and be operationally engaged with the latch to be operated, the spring pressed engagement of the half-round spindle in the particular socket of the spindle retainer is not always sufficiently secure. Keeping in mind that the sole means for transferring the intended rotational motion of the latch operating mechanism into the longitudinal motion of latch operation is the spindle, any failure in this motion transfer arrangement will cause complete failure of latch operation. Furthermore, with this modified spindle retainer arrangement, unless the end of the half-round spindle is totally properly inserted into the particular spindle retainer socket, the train of motion transfer can again be accidentally lost.

Thus, although the alternate spindle positioning concept with a single latch operating mechanism is highly desirable to retain, the manner of selectively connecting the spindle end in its alternate position requires improvement. In addition, the alternate spindle positioning concept can be further improved and made more problem free by offering the concept in a construction which does not depend upon complete assembly separation and reassembly in the alternate position. Rather, the alternate positioning of the spindle should be in a form of a more positive, foolproof nature so that if the latch operating mechanism including the spindle originally properly operates the latch, it cannot fail by disassembly after a period of time.

Further referring to the prior U.S. Pat. No. 3,704,036, in the particular instance where the latch operating device is of the thumb lever actuating type, various improvements in the complexity thereof are warranted. Reviewing the construction disclosed in the patent, a vertically pivotal thumb lever end wise engages an actuating block or yoke vertically slideable in a slide frame. The yoke, in turn, engages and vertically pivots an actuating lever which likewise end engages and vertically reciprocates a slide bar. Finally, the slide bar is engaged with a radial crank arm attached to the previously described spindle retainer and latch engaged spindle.

In operation, pivotally depressing the thumb lever vertically slideably raises the yoke which pivots the actuating lever in an arc vertically upwardly. The upward movement of the actuating lever end moves the slide bar upwardly forcing the radial crank arm to partially rotate the spindle retainer and thereby partially rotate the spindle to actuate the latch. In basic effect, these variously interconnected elements transform the vertically pivotal motion of the thumb lever into the partial rotational motion of the spindle retainer and spindle for carrying out the actuation of the latch. Although this motion conversion is of a relatively complex nature requiring relatively complex element connections, improvement of the same is warranted as hereinbefore stated.

OBJECTS AND SUMMARY OF THE INVENTION

It is, therefore, an object of this invention to provide a latch operating device incorporating the beforedescribed alternate spindle positioning concept wherein the connection of the spindle to its associated latch operating mechanism is greatly improved and eliminates the possible difficulties with the prior construction. In its broader aspects, and regardless of the particular type of latch operating mechanism involved, the spindle is operationally connected to the latch operating mechanism such that the spindle is normally in a positively engaged position effectively receiving rotational motion from the latch operating mechanism and transferring such rotational motion into actuation of the latch with which the spindle is engaged. At the same time, however, even though normally retained in this positive actuating position without the danger of disengagement from the latch operating mechanism during normal latch actuation, merely by a selective movement of the spindle along its rotational axis, the spindle is completely disengaged from rotational drive by the latch operating mechanism and is freely rotatable so as to be readily repositionable in an alternate position relative to the latch operating mechanism so as to then adapt the spindle to the alternate positioning requirement.

It is a further object of this invention to provide a latch operating device incorporating the alternate spindle positioning concept wherein despite the fact that the spindle is normally retained in its engaged operational position with its latch operating mechanism and despite the fact that it may be selectively simply moved along its rotational axis for the alternate repositioning thereof, the spindle is never completely separable from its latch operating mechanism before, during or after such repositioning, thereby eliminating the dangers of improper assembly during the repositioning which can ultimately cause failure in latch actuation. In such preferred form according to certain of the principles of the present invention, the spindle is normally positively resiliently retained in its operational position rotatively engaged with the latch operating mechanism. However, during movement of the spindle to its freely rotatable position at which time the spindle repositioning can be accomplished, the resilient means is compressed permitting such spindle movement and during reengagement into rotational connection with the latch operating mechanism, the resilient means forces positive reestablishment of the required relationship.

It is still another object of this invention to provide a latch operating device incorporating the alternate spindle positioning concept wherein, due to the unique spindle connection for permitting the alternate spindle positioning, such spindle connection is particularly adapted to integration into a latch operating mechanism of greatly simplified form. In the overall preferred form of the present invention, the latch operating mechanism may be of a known pinion and rack form readily lending itself to thumb lever actuation with the relatively simple transformation of rack sliding motion resulting from thumb lever pivotal motion into the pinion rotational motion ultimately required for partial rotation of a latch actuating spindle. Thus, again in the overall preferred form, the spindle may be directly secured to the pinion for rotation at all times therewith, the spindle being positively partially rotated by the rack in normal engagement of the pinion with the rack, but the pinion moving along the spindle rotational axis with the spindle and disengaging from the rack during movement of the spindle into its temporary disengaged position and free rotation of both the spindle and pinion for the spindle alternate repositioning.

Other objects and advantages of the invention will be apparent from the following specification and the accompanying drawings which are for the purpose of illustration only.

Figure 1:
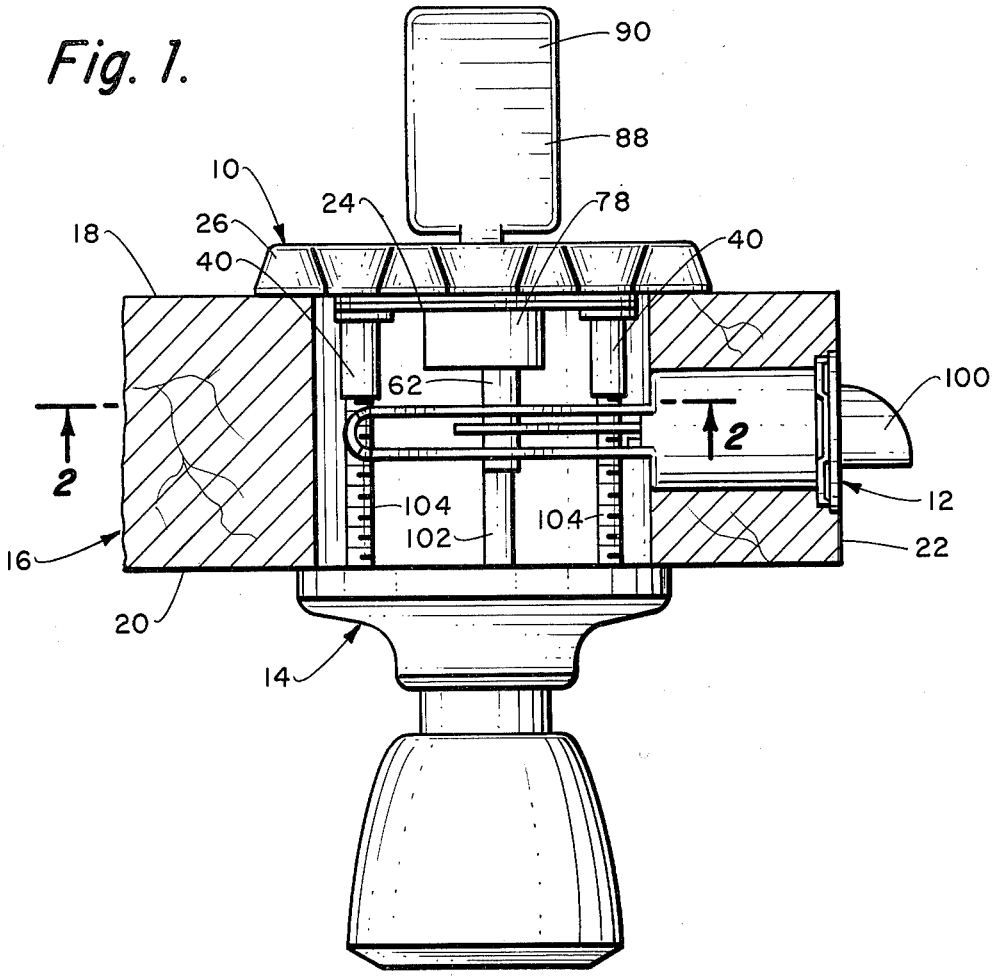
FIG. 1 is a top plan view of thumb lever actuated latch operating device incorporating a preferred embodiment of the operating and latch connection improvements of the present invention, the latch operating device being assembled with a typical latch and a typical knob actuated latch operating device, all mounted in operable position in a door shown in fragmentary horizontal sectional view, the latch operating devices and the latch being shown in the "at rest" position with the latch bolt extended.
Figure 2:
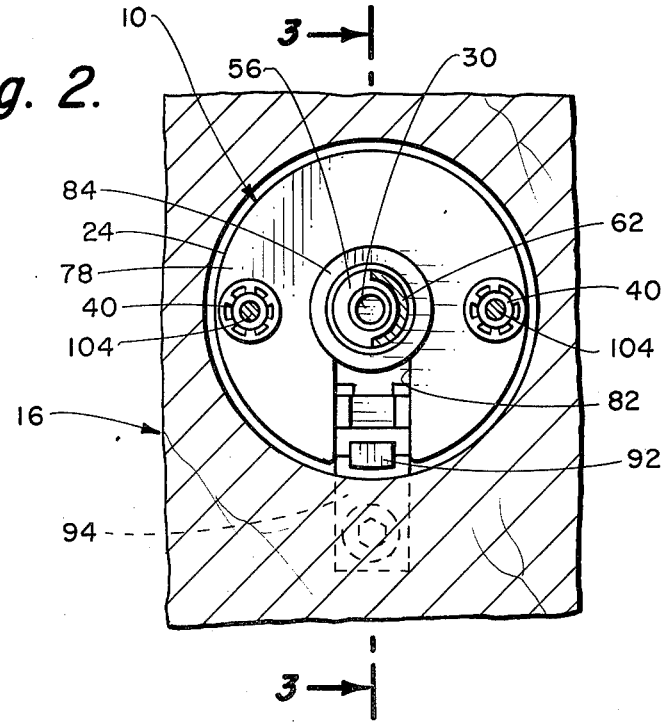
FIG. 2 is a vertical sectional view looking in the direction of the arrows 2—2 in FIG. 1 with the thumb lever actuated latch operating device of FIG. 1 still in the "at rest" position.

DESCRIPTION OF THE BEST EMBODIMENT CONTEMPLATED:

Referring for the moment to FIG. 1, a preferred embodiment of a latch operating device incorporating the operating and latch connection improvements in preferred form therein is shown as a thumb lever actuated latch operating device generally indicated at 10. The thumb lever latch operating device 10 is shown in functional assembly with a typical latch generally indicated at 12 and a typical knob actuated latch operating device generally indicated at 14, all mounted with a door generally indicated at 16. In general usual manner, the thumb lever actuated latch operating device 10 is mounted projecting from and exposed at one side 18 of the door 16, the knob actuated operating device 14 is mounted projecting from and exposed at an opposite side 20 of the door and the latch 12 is mounted within the door operably engaged by both of the latch operating devices and exposed at an edge 22 of the door. Except as hereinafter specifically pointed out, all of the latch operating devices 10 and 14 and the latch 12 may be formed of usual materials and manufactured by usual manufacturing procedures.

More particularly, to the thumb lever latch operating device 10 incorporating the principles of the present invention and referring to FIGS. 1 through 3, 5 and 7, the thumb lever latch operating device includes a generally cylindrical main frame 24 having a somewhat typical rosette plate 26 preferably integrally formed therewith at its outer extremity. Facing inwardly, the main frame 24 is formed with an inwardly opening, generally rectangular rack recess 28 which is interrupted substantially midway thereof by an inwardly projecting, cylindrical pinion stud 30. At its upper edge, the rack recess 28 is formed with a downwardly opening spring keeper slot 32, at its lower edge with a through retainer slot 34 and at its opposite side with rack abutment bars 36, all as probably best seen in FIG. 7. Completing the main frame 24, a thumb lever pivotal opening 38 having a known configuration is formed opening forwardly and rearwardly through the main frame 24 including the rosette plate 26 aligned with the recess retainer slot 34, and rearwardly projecting, internally threaded mounting studs 40 are positioned one at either side of the rack recess 28.

A generally rectangular rack plate 42 has a generally vertical rack slot 44 formed therein with a rack 46 formed bordering one side of the slot. Midway of an upper edge surface of the rack plate 42 is formed a spring keeper tab 48 and toward the rack plate lower edge underlying the rack slot 44 is secured an actuator plate 50. The rack plate 42 is appropriately sized for reception in the main frame rack recess 28 and vertically slideable operating movement therein as will be hereinafter described more in detail.

Figures 7, 8:
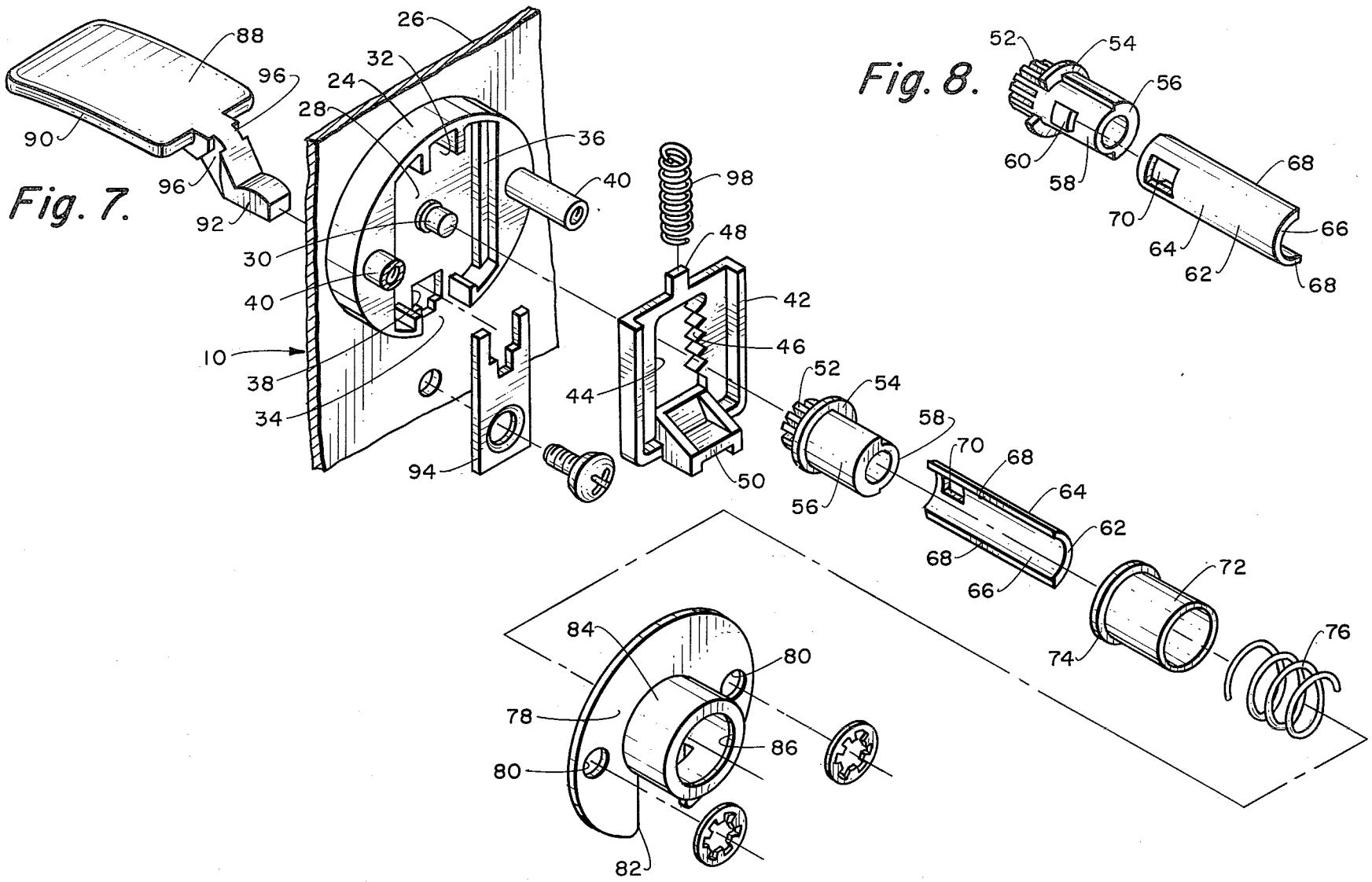
FIG. 7 is an exploded view of the thumb lever actuated latch operating device of FIGS. 1 through 6, certain of the parts being shown broken away for increased clarity and brevity.
FIG. 8 is an exploded view of the pinion, a portion of the spindle retainer and the spindle all taken directly from FIG. 7, but with such parts being selectively rotated to place the spindle in its alternate position.

Formed operably interengageable with the rack 46 of the rack plate 42 is a pinion 52 which is rearwardly secured at an end flange 54 of a hollow cylindrical spindle retainer 56. A semi-circular spindle recess 58 is formed in the spindle retainer 56 extending axially of the spindle retainer outer surface from the end flange 54 the complete length thereof as best seen in FIG. 8. Also as best seen in FIG. 8, the spindle retainer 56 is provided with a radially projecting tab 60 spaced axially from the end flange 54 and circumferentially intermediate the spindle recess 58.

Adapted for radial and axial reception into the spindle recess 58 of the spindle retainer 56 is a somewhat conventionally configured half-round spindle 62, the spindle having the usual outer and inner semi-circular arcuate surfaces 64 and 66 terminating circumferentially in axially extending edges 68. Additionally, the spindle 62 has a tab engagement opening 70 formed radially therethrough and appropriately positioned for reception of the tab 60 of the spindle retainer 56 when the spindle is positioned in the spindle recess 58. This tab 60 and tab engagement opening 70 interengagement serves to retain the spindle 62 both axially and circumferentially in its position in the spindle recess 58, the circumferential edges of the retainer spindle recess also prohibiting relative circumferential movement between the spindle and spindle retainer.

A generally hollow cylindrical or sleeve-like spindle retainer cap 72 may be axially slideably received over the spindle retainer 56 and has an end flange 74 which will axially abut the end flange 54 of the spindle retainer. A coil compression spring 76 is receivable axially slideably telescoped over the spindle retainer cap 72 into abutment against the end flange 74, and a main frame cover plate 78 is receivable axially telescoped over the spindle retainer cap 72 and the compression spring 76. The main frame cover plate 78 is formed with stud openings 80 for reception of the main frame mounting studs 40 therethrough in assembly as will be hereinafter described more in detail and is also formed with a downwardly opening thumb lever clearance slot 82 as shown. A hollow cylindrical part 84 of the main frame cover plate 78 is that portion directly telescoping the spindle retainer 56 and the compression spring 76 with the compression spring free to move axially therein, and an end spring flange 86 of the cylindrical part abuts the extremity of the compression spring to axially captivate the same axially between that spring flange and the end flange 54 of the spindle retainer.

The final principal elements of the thumb lever latch operating device 10 are a somewhat usually configured thumb lever 88 having a finger actuating part 90 and a latch actuating end part 92, and a thumb lever retainer 94 for securing the thumb lever in operable pivotal position. The thumb lever 88, as stated, is of usual configuration including the opposite side vertical slots 96 which slideably receive the thumb lever retainer 94 therein when the thumb lever is assembled while still permitting pivotal movement of the thumb lever in a well known manner.

In assembly of the thumb lever latch operating device 10 just described, the latch actuating end part 92 of the thumb lever 88 is inserted from outwardly inwardly through the thumb lever pivot 38 of the main frame 24 until the thumb lever slots 96 are within the main frame rack recess 28. The thumb lever retainer 94 is then slid upwardly to engage in the thumb lever slots 96 with the thumb lever retainer then being secured to the inner surface of the rosette plate 26. This obviously secures the thumb lever 88 vertically pivotal with the main frame 24 within the main frame retainer slot 34 and the latch actuating end part 92 of the thumb lever upwardly exposed to the main frame rack recess 28.

The rack plate 42 is inserted into the main frame rack recess 28 telescoping the pinion stud 30 and vertically slideably abutting the rack abutment bars 36. A coil compression rack control spring 98 is received with its lower end over the spring keeper tab 48 of the rack plate 42 and the upper extremity thereof received in the spring keeper slot 32 of the main frame 24. The rack plate 42 with its rack 46 is, therefore, vertically slideable in the main frame rack recess 28 always urged vertically downwardly within the rack recess by the rack control spring 98 so that the actuator plate 50 of the rack plate overlies and is always resiliently urged to downwardly abut the latch actuating end part 92 of the thumb lever 88.

The pinion 52 with the spindle retainer 56 is axially inserted into the rack slot 44 of the rack plate 42 rotatably received over the main frame pinion stud 30 and operably interengaged with the rack 46. The spindle 62 is positioned in the spindle recess 58 of the spindle retainer 56 interengaged with the tab 60 and both the spindle retainer 56 and the spindle 62 are telescoped by the spindle retainer cap 72. The compression spring 76 is telescoped over the spindle retainer cap 72 and the main frame cover plate 78 is telescoped over the spindle retainer cap 72 and the compression spring 76, the main frame cover plate 78 engaging over the main frame mounting studs 40 so as to cover the main frame rack recess 28 and retain the rack plate 42, pinion 52 and spindle retainer 56, spindle 62, spindle retainer cap 72 and compression spring 76 all in proper operable assembly.

Figure 3:
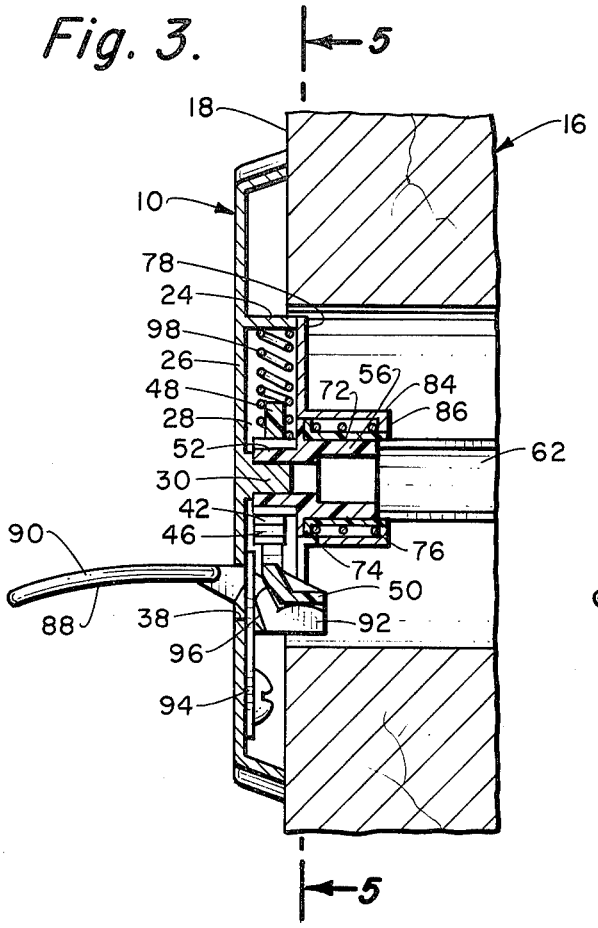
FIG. 3 is a vertical sectional view looking in the direction of the arrows 3—3 in FIG. 2 with the thumb lever actuated latch operating device of FIG. 1 still in the "at rest" position.

In such operable assembly, the rack control spring 98 within the main frame rack recess 28 normally resiliently urges the rack plate 42 its maximum slideable distance downwardly so that the actuator plate 50 of the rack plate downwardly abuts the latch actuating end part 92 of the thumb lever 88 normally resiliently retaining the finger actuating part 90 of the thumb lever vertically pivotally upwardly as particularly shown in FIG. 3. At the same time, this resiliently urged positioning of the latch plate 42 through the interengagement of the rack 46 with the pinion 52, the pinion being resiliently retained in such rack interengagement by the axial resilient urging of the compression spring 76, positions the spindle 62 in a present non-actuating position relative to a particular latch. In the present overall assembly of the thumb lever latch operating device 10 with the latch 12 and the knob latch operating device 14 in the door 16 as will be hereinafter described, the preset non-actuating position of the spindle 62 is with the spindle outer surfaces 64 facing longitudinally forwardly of the latch and the spindle edges 68 facing longitudinally rearwardly.

Important to the principles of the present invention, it should be noted that with the operable interengagement between the rack 46 of the rack plate 42 and the pinion 52 being resiliently retained by the compression spring 76 against the spindle retainer 56, by selective deliberate axial movement of the unitarily secured pinion 52 and spindle retainer 56 along the spindle retainer axis rearwardly or inwardly away from the rack plate 42 and its rack, will compress the compression spring 76 and completely disengage the rack and pinion. This selected deliberate action thereby moves the spindle 62 from an operably engaged position to a freely rotatable disengaged position, that is, the pinion 52, spindle retainer 56 and spindle 62 being freely rotatable relative to the rack plate 42. This permits the spindle 62 to be selectively repositioned relative to its latch operating mechanism so that the position of the spindle may be completely rotatably reversed, thereby readapting the overall thumb lever latch operating device 10 for opposite door side mounting operable to actuate the exact same form of latch when the pinion 52, spindle retainer 56 and spindle 62 are permitted to move axially back into the interengaged positioning of the rack 46 with the pinion in this altered reversed position, such reverse position being illustrated in FIG. 8 by a comparison between FIGS. 7 and 8.

According to the principles of the present invention, therefore, a latch operating device is provided making use of a spindle and latch requiring preset positioning of the spindle relative to the latch wherein the spindle may be selectively moved along its axis from an operable engaged position operably engaged with its latch operating device to a freely rotatable disengaged position for repositioning of the spindle when alternate door side mounting is required. Furthermore, in the more specific form shown of the latch operating mechanism comprised of the rack 46 and the pinion 52, such repositioning of the spindle 62 may be accomplished merely by simultaneously not only axially moving the spindle, but attaching thereto the pinion 52 through the spindle retainer 56. This completely disengages the partially rotatable drive to the spindle 62 making it freely rotatable for such repositioning and the reengagement is established merely by permitting the various elements to return to their original normal interengagements, in this case, releasing the spindle 62, spindle retainer 56 and pinion 52 to reestablish the interengaged relationship in the new spindle positioning between the pinion and rack.

To complete the overall assembly of the thumb lever latch operating device 10, latch 12 and knob latch operating device 14 with the door 16 as shown in FIGS. 1 through 3 and 5, the latch 12 is positioned within the door 16 as shown in FIG. 1 extending longitudinally parallel to the door sides 18 and 20 and with its bolt 100 normally projecting longitudinally from the door edge 22. The thumb lever latch operating device 10 just described is then positioned at the door one side 18 with the spindle 62 operably engaged through the latch 12 and the known form of knob latch operating device 14 is positioned at the door opposite side 20 with its similar half round spindle 102 also operably engaged with the latch 12 telescoped by the spindle 62. The thumb lever latch operating device 10 and knob latch operating device 14 are then secured in the described assembly by fastening engagement of screws 104 of the knob latch operating device 14 threadably into the mounting studs 40 of the thumb lever latch operating device 10 completing the assembly as shown.

In operation of the latch 12 by the thumb lever latch operating device 10 in this overall assembly in the door 16, downward depression of the finger actuating part 90 of the thumb lever 88 from its latch non-actuating position shown, pivots the thumb lever to raise the latch actuating end part 92 upwardly urging the rack plate 42 upwardly compressing the rack control spring 98. Upward movement of the rack plate 42 moves the rack 46 upwardly and through its operable interengagement with the pinion 52, partially rotates the pinion and the spindle 62 through the spindle retainer 56 so as to actuate the latch 12 in the usual manner withdrawing the bolt 100 into the door edge 22. Release of the thumb lever 88 permits the return of the various elements of the thumb lever latch operating device 10 and the latch 12 to non-actuated position as resiliently urged by the rack control spring 98 and a similar spring or springs within the latch 12 so as to again project the bolt 100. The latch 12 is similarly actuated by partial rotation of the knob latch operating device 14 in the usual manner.

Figure 4:
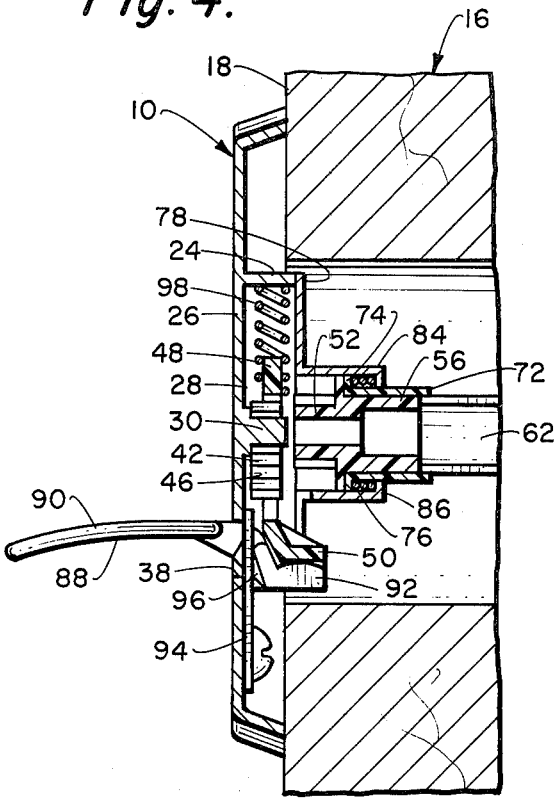
FIG. 4 is a vertical sectional view similar to FIG. 3, but showing the connection means improvements of the present invention being operated for placing the spindle of the thumb lever actuated latch operating device in its alternate position.
Figure 5:
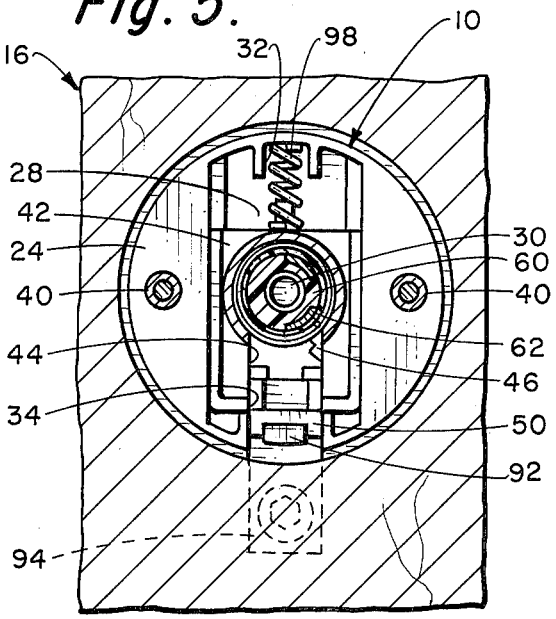
FIG. 5 is a vertical sectional view looking in the direction of the arrows 5—5 in FIG. 3 and showing the thumb lever actuated latch operating device in the position of FIG. 3.
Figure 6:
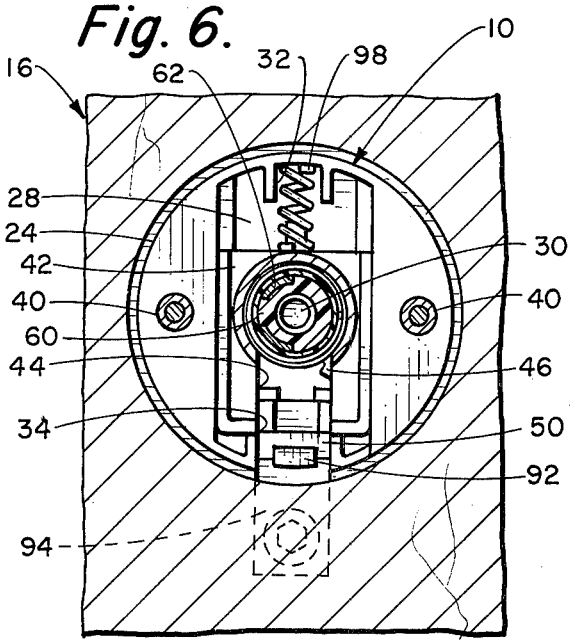
FIG. 6 is a vertical sectional view similar to FIG. 5 and showing the thumb lever actuated latch operating device in the position of FIG. 4.

As an illustration of the improvements of the present invention in the overall assembly of FIG. 1, assume that the latch 12 must extend in the opposite longitudinal direction from that shown in FIG. 1 which would require the half-round spindles 62 and 102 to have their outer surfaces, for instance, the outer surfaces 64 of spindle 62, facing in diametrically opposite directions longitudinally of the latch 12, the spindle 62 of the thumb lever latch operating device 10 is merely grasped and pulled inwardly away from the main frame 24 as shown in FIG. 4 which moves the pinion 52 through the spindle retainer 56 axially out of engagement with the rack 46 of the rack plate 42 by compression of the compression spring 76. The spindle 62 with its pinion 52 and spindle retainer 56 is then rotated one half turn from the position shown in FIG. 4 to the position shown in FIG. 6 and then released. This permits the spindle 62 with its pinion 52 and spindle retainer 56 to return by the urging of the compression spring 76 reengaging the pinion with the rack 46 of the rack plate 42 to again place the thumb lever latch operating device 10 in operable condition but with the spindle 62 oriented to the different positioning of the latch 12.

Thus, according to the principles of the present invention, a latch operating device is provided of the type requiring a specific preset spindle positioning for proper actuation of a related latch wherein the spindle is uniquely arranged for diametrically opposite positioning merely by a selected movement thereof along its longitudinal axis. Upon such selected movement, the spindle is freely rotatable relative to the remainder of the latch operating device and when then reengaged into the alternate positioning with the latch operating device, the latch operating device may again be actuated in the same manner but with such spindle alternate positioning. To accomplish the spindle alternate positioning, no overall disassembly of the latch operating device is required nor is a substitute form of spindle required.

When the spindle repositioning improvements of the present invention are incorporated into a thumb lever latch operating device having a rack and pinion actuating mechanism, even though the general concept of rack and pinion actuation is known to those skilled in the art, the rack and pinion arrangement combined with the alternate spindle positioning improvements of the present invention cooperate in a unique manner to provide a highly convenient and efficient assembly. Where the latch operating device is thumb lever actuated, for instance, the rack and pinion interconnection provides a highly simplified arrangement for translating thumb lever pivotal movement into spindle partial rotational movement and at the same time, by securing the pinion directly movable with the spindle during spindle repositioning, the pinion is automatically disengaged from its driving rack during spindle repositioning permitting the free rotation of both the pinion and spindle. In the alternate positioning of the spindle, then, it is only necessary to reposition the spindle for reengaging the pinion with its normally interengaged rack and all proper operable connection is reestablished for resuming proper latch operating device movements.

It is pointed out that as illustrated herein, the alternate spindle positioning principles of the present invention are related to a latch operating device incorporating pinion and rack interengagement for actuation, but that it is not intended thereby to limit the alternate spindle positioning principles of the present invention to that arrangement alone even though the same results in a distinctively improved combination. It is clear to those skilled in the art that the alternate spindle positioning principles herein involved are equally applicable to other forms of latch operating devices which are fully contemplated. Thus, the principles of the present invention are not intended to be restricted beyond the limitations contained in the appended claims.

I claim:

1. In a latch operating device of the type imparting motion of an operating mechanism into partial rotation of a transversely extending spindle operably engaged with a longitudinally reciprocal latch, said spindle being half-round and having a semi-circular outer surface over a portion thereof, the operable connection between said spindle and latch operationally requiring said spindle semi-circular outer surface in non-operating position to always face in only a particular one of generally longitudinally forwardly and rearwardly direction regardless of the transverse side of said latch at which said operating mechanism is positioned; the improvements comprising: spindle mounting means operably connected to said operating mechanism so as to be positively partially rotatable about a transverse axis by said operating mechanism when in a normal engaged position with said operating mechanism and freely rotatable about said transverse axis when disengaged from said operating mechanism in a temporary disengaged position; said spindle being secured to said spindle mounting means rotatable therewith about said transverse axis, free rotation of said spindle with said spindle mounting means in said spindle mounting means temporary disengaged position permitting selective positioning of said spindle with said spindle semi-circular outer surface always facing in said particular one longitudinal direction for said spindle mounting means normal engaged position regardless of the transverse side positioning of said operating mechanism relative to said latch.

2. In a latch operating device as defined in claim 1 in which said spindle mounting means is movable axially along said transverse axis between said normal engaged and temporary disengaged positions.

3. In a latch operating device as defined in claim 1 in which said spindle mounting means is selectively axially movable along said transverse axis between said normal engaged and temporary disengaged positions, resilient means operably connected to said spindle mounting means normally resiliently urging said spindle mounting means into said normal engaged position and compressed upon selective movement of said spindle mounting means into said temporary disengaged position.

4. In a latch operating device as defined in claim 1 in which a stationary housing is mounted over said spindle mounting means with said spindle mounting means being slideable relative thereto during movement between said normal engaged and temporary disengaged position; and in which resilient means is mounted between said stationary housing and said spindle mounting means normally urging said spindle mounting means into said normal engaged position and compressible for permitting said spindle mounting means movement into said temporary disengaged position.

5. In a latch operating device as defined in claim 1 in which said spindle mounting means is generally cylindrical; in which a generally hollow cylindrical stationary housing is mounted over said spindle mounting means with said spindle mounting means being freely rotatable relative to said stationary housing in all positions of said spindle mounting means and with said spindle mounting means being axially slideable along said transverse axis relative to said stationary housing; and in which a coil compression spring is mounted within said stationary housing between said stationary housing and said spindle mounting means normally urging said spindle mounting means to its normal engaged position and compressing to permit movement of said spindle mounting means to its temporary disengaged position.

6. In a latch operating device as defined in claim 1 in which said spindle is secured to said spindle mounting means by connection means operable for permitting selective removal of said spindle from said spindle mounting means and replacement by a spindle of different size.

7. In a latch operating device as defined in claim 1 in which said spindle is secured to said spindle mounting means by connection means operable for permitting selective removal of said spindle from said spindle mounting means and replacement by a spindle of different size; in which said spindle mounting means is selectively axially movable along said transverse axis between said normal engaged and temporary disengaged positions, resilient means operably connected to said spindle mounting means normally resiliently urging said spindle mounting means into said normal engaged position and compressed upon selective movement of said spindle mounting means into said temporary disengaged position.

8. In a latch operating device as defined in claim 1 in which said spindle is secured to said spindle mounting means by connection means operable for permitting selective removal of said spindle from said spindle mounting means and replacement by a spindle of different size; in which a stationary housing is mounted over said spindle mounting means with said spindle mounting means being slideable relative thereto during movement between said normal engaged and temporary disengaged position; and in which resilient means is mounted between said stationary housing and said spindle mounting means normally urging said spindle mounting means into said normal engaged position and compressible for permitting said spindle mounting means movement into said temporary disengaged position.

9. In a latch operating device as defined in claim 1 in which said operating mechanism includes a slideable rack engaged with a pinion, said pinion being operably connected to said spindle mounting means transforming rack slideable movement into positive partial rotation of said spindle mounting means when said spindle mounting means is in said normal engaged position.

10. In a latch operating device as defined in claim 1 in which said operating mechanism includes a slideable rack engaged with a pinion, said pinion being operably connected to said spindle mounting means transforming rack slideable movement into positive partial rotation of said spindle mounting means when said spindle mounting means is in said normal engaged position; and in which a pivotally mounted thumb lever is operably connected to said rack for selectively slideably moving said rack.

11. In a latch operating device as defined in claim 1 in which said spindle mounting means is movable axially along said transverse axis between said normal engaged and temporary disengaged positions; and in which said operating mechanism includes a slideably movable rack and a pinion, said pinion being secured to said spindle mounting means axially movable therewith, said pinion being engaged with said rack when said spindle mounting means is in said normal engaged position imparting partial rotation to said spindle mounting means during slideable movement of said rack, said pinion moving axially with said spindle mounting means and disengaging from said rack upon movement of said spindle mounting means to its temporary disengaged position.

12. In a latch operating device as defined in claim 1 in which said spindle mounting means is movable axially along said transverse axis between said normal engaged and temporary disengaged positions; in which said operating mechanism includes a slideably movable rack and a pinion, said pinion being secured to said spindle mounting means axially movable therewith, said pinion being engaged with said rack when said spindle mounting means is in said normal engaged position imparting partial rotation to said spindle mounting means during slideable movement of said rack, said pinion moving axially with said spindle mounting means and disengaging from said rack upon movement of said spindle mounting means to its temporary disengaged position; and in which resilient means is operably connected to said spindle mounting means for normally urging said spindle mounting means into its normal engaged position and said pinion into its rack engaged position, said resilient means compressing during movement of said spindle mounting means to its temporary disengaged position and said pinion into its rack disengaged position.

13. In a latch operating device as defined in claim 1 in which said spindle mounting means is movable axially along said transverse axis between said normal engaged and temporary disengaged positions; in which said operating mechanism includes a slideably movable rack and a pinion, said pinion being secured to said spindle mounting means axially movable therewith, said pinion being engaged with said rack when said spindle mounting means is in said normal engaged position imparting partial rotation to said spindle mounting means during slideable movement of said rack, said pinion moving axially with said spindle mounting means and disengaging from said rack upon movement of said spindle mounting means to its temporary disengaged position; and in which a stationary housing is slideably engaged with said spindle mounting means permitting said spindle mounting means movement in said partial rotation and between its normal engaged and temporary disengaged positions, said stationary housing being connected to said spindle mounting means through resilient means normally urging said spindle mounting means into its normal engaged position and said pinion into its rack engaged position, said resilient means compressing during movement of said spindle mounting means to its temporary disengaged position and said pinion to its rack disengaged position.

14. In a latch operating device as defined in claim 1 in which said spindle mounting means is movable axially along said transverse axis between said normal engaged and temporary disengaged positions; in which said operating mechanism includes a slideably movable rack and a pinion, said pinion being secured to said spindle mounting means axially movable therewith, said pinion being engaged with said rack when said spindle mounting means is in said normal engaged position imparting partial rotation to said spindle mounting means during slideable movement of said rack, said pinion moving axially with said spindle mounting means and disengaging from said rack upon movement of said spindle mounting means to its temporary disengaged position; in which said spindle is secured to said spindle mounting means by connection means operable for permitting selective removal of said spindle from said spindle mounting means and replacement by a spindle of different size; and in which a pivotal thumb lever is operably connected to said rack imparting slideable movement to said rack upon selective pivoting of said thumb lever.

* * * * *